US008162443B2

(12) United States Patent
Xie

(10) Patent No.: US 8,162,443 B2
(45) Date of Patent: Apr. 24, 2012

(54) PAIRED DROP EJECTOR METHOD OF OPERATION

(75) Inventor: Yonglin Xie, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 353 days.

(21) Appl. No.: 12/543,749

(22) Filed: Aug. 19, 2009

(65) Prior Publication Data

US 2011/0043572 A1 Feb. 24, 2011

(51) Int. Cl.
*B41J 2/05* (2006.01)

(52) U.S. Cl. ..... 347/57; 347/56; 347/65

(58) Field of Classification Search ..... 347/20, 347/44, 47–48, 56–58, 61–65, 67, 92–94
See application file for complete search history.

(56) References Cited

U.S. PATENT DOCUMENTS 4,611,219 A * 9/1986 Sugitani et al. ..... 347/65
5,731,827 A 3/1998 Mantell et al.
6,447,088 B2 * 9/2002 Tachihara et al. ..... 347/48

FOREIGN PATENT DOCUMENTS

EP 1705013 A1 * 9/2006

OTHER PUBLICATIONS

Y. Xie, "Paired Drop Ejector", U.S. Appl. No. 12/543,712, filed herewith.

* cited by examiner

*Primary Examiner* — Juanita D Jackson
(74) *Attorney, Agent, or Firm* — Peyton C. Watkins

(57) ABSTRACT

A method of ejecting droplets of liquid from a paired drop ejector, the method includes the steps of providing a chamber having a dividing wall that forms a first and second portion and the first portion includes a first nozzle mated with a first heater and the second portion includes a second nozzle mated with a second heater; providing liquid to the first portion and second portions of the chamber through an open end of the enclosure; providing a first electrical pulse to the first heater to provide thermal energy for ejecting a droplet of liquid from the first nozzle; and providing a second electrical pulse to the second heater to provide thermal energy for ejecting a droplet of liquid from the second nozzle; wherein the second electrical pulse is delayed relative to the first electrical pulse by a first predetermined delay time.

20 Claims, 11 Drawing Sheets

PAIRED DROP EJECTOR METHOD OF OPERATION

CROSS-REFERENCE TO RELATED APPLICATIONS

Reference is made to commonly assigned, co-pending U.S. patent application Ser. No. 12/543,712, filed herewith, entitled: "Paired Drop Ejector", by Yonglin Xie, the disclosure of which is incorporated herein.

FIELD OF THE INVENTION

This invention relates generally to the field of liquid drop ejectors, and more particularly to a method of operation of a high frequency drop ejector for an inkjet printhead.

BACKGROUND OF THE INVENTION

Liquid drop ejectors are used in a variety of industries to precisely and controllably dispense droplets of liquid. Drop ejectors can be used, for example, in the medical, chemical and printing industries.

Inkjet printing systems include one or more printheads that have arrays of drop ejectors that are controlled to make marks of particular sizes, colors, or densities in particular locations on the recording medium in order to print the desired image. In some types of inkjet printing systems the array(s) of dot forming elements extends across the width of the page, and the image can be printed one line at a time, as the recording medium is moved relative to the printhead. Alternatively, in a carriage printing system (whether for desktop printers, large area plotters, etc.) the printhead or printheads are mounted on a carriage that is moved past the recording medium in a carriage scan direction as the dot forming elements are actuated to make a swath of dots. At the end of the swath, the carriage is stopped, printing is temporarily halted and the recording medium is advanced. Then another swath is printed, so that the image is formed swath by swath.

An inkjet drop ejector includes a nozzle and a drop forming mechanism (such as a resistive heater for thermal inkjet, or a piezoelectric device for piezoelectric inkjet) in order to generate pressure within an ink-filled chamber and eject ink from the nozzle. In page-width inkjet printers as well as in carriage inkjet printers, the printhead and the recording medium are moved relative to one another as drops are ejected in order to form the image.

A limitation to how quickly an image can be printed is the refill time of the drop ejector. The refill time is the time required for the chamber to refill with ink so that a subsequent drop can be ejected after ejecting a previous drop. When a drop is ejected, a portion of the ink in the chamber exits the nozzle, and another portion of ink is pushed back toward the ink source. Capillary forces cause additional ink to refill the chamber from the ink source. Refill time depends on ink properties, such as surface tension and viscosity, as well as drop ejector geometries and surface properties, and operating conditions such as temperature. During refill, the ink meniscus approaches the nozzle opening, and can temporarily extend past the nozzle opening if the refill is underdamped. The refill time is the time such that the ink volume in the chamber is sufficiently replenished and the ink meniscus is sufficiently stabilized so that the drop volume and velocity of a subsequent drop of ink is similar to that of the previous drop of ink.

Refill time can be shortened by decreasing the volume of the drop of ink. However, in order to make sufficiently large spots of ink on the print medium to provide proper image quality, the drop volume is generally set to a particular drop volume or range of drop volumes. Refill time can also be shortened by increasing the surface tension and/or decreasing the viscosity of the ink. However, surface tension cannot be increased too much or the ink drops will not wick into the print medium sufficiently fast to achieve required dry times. In addition, viscosity cannot be decreased too much or the ink drops will not remain sufficiently localized in the location where they hit the print medium.

Consequently, a need exists for a method of operating a drop ejector that enables a short refill time to allow high frequency ejection of inks or other liquids having sufficiently large drop volume, sufficiently small surface tension, and sufficiently high viscosity.

SUMMARY OF THE INVENTION

The present invention is directed to overcoming one or more of the problems set forth above. Briefly summarized, according to one aspect of the invention, the invention resides in a method of ejecting droplets of liquid from a paired drop ejector, the method comprising the steps of providing a chamber having a dividing wall that forms a first and second portion and the first portion includes a first nozzle mated with a first heater and the second portion includes a second nozzle mated with a second heater; providing liquid to the first portion and second portions of the chamber through an open end of the enclosure; providing a first electrical pulse to the first heater to provide thermal energy for ejecting a droplet of liquid from the first nozzle; and providing a second electrical pulse to the second heater to provide thermal energy for ejecting a droplet of liquid from the second nozzle; wherein the second electrical pulse is delayed relative to the first electrical pulse by a first predetermined delay time.

These and other objects, features, and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

While the specification concludes with claims particularly pointing out and distinctly claiming the subject matter of the present invention, it is believed that the invention will be better understood from the following description when taken in conjunction with the accompanying drawings, wherein:

DETAILED DESCRIPTION OF THE INVENTION

Figure 1:
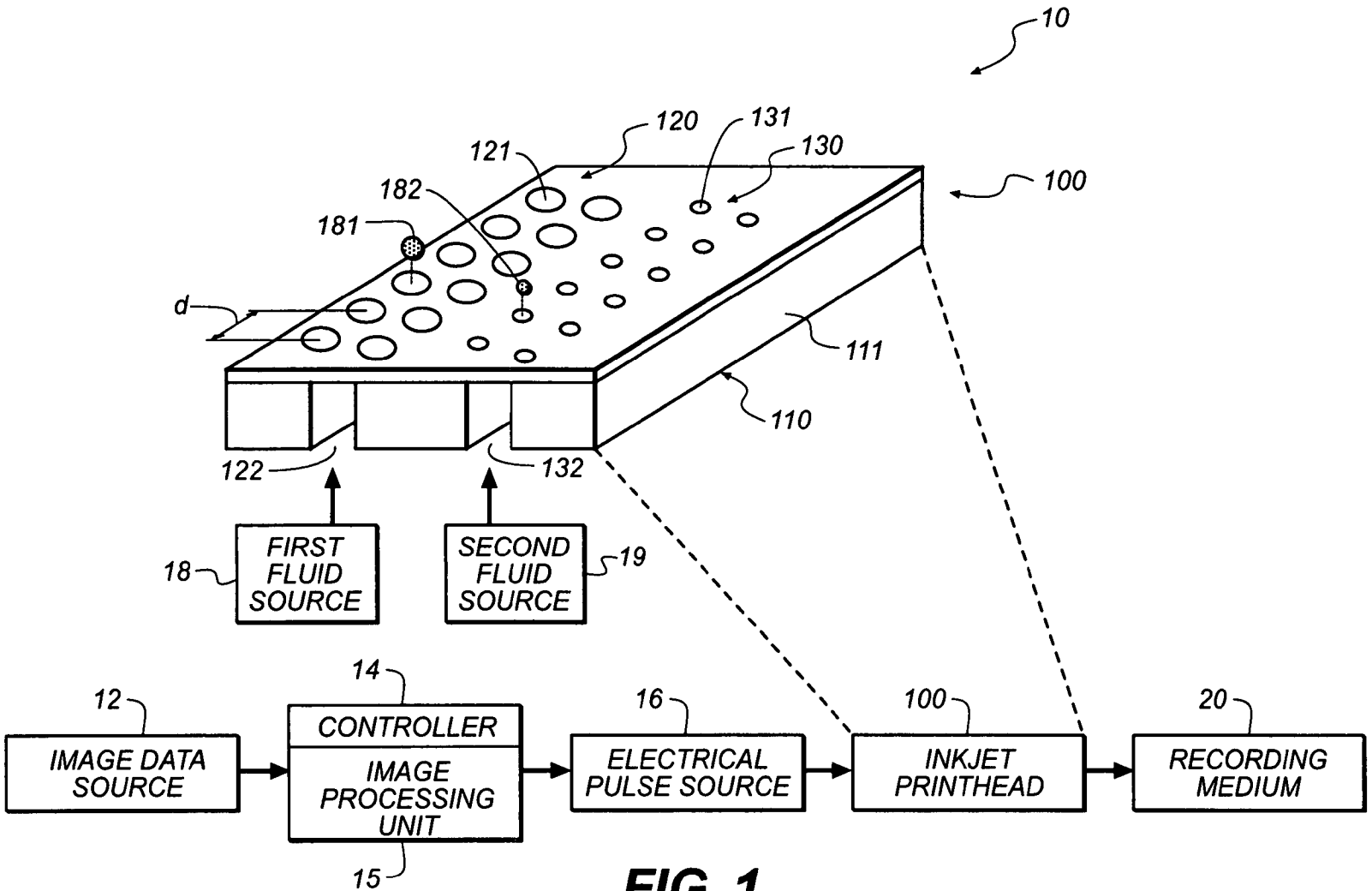
FIG. 1 is a schematic representation of an inkjet printer system.

Referring to FIG. 1, a schematic representation of an inkjet printer system 10 is shown, for its usefulness with the present invention and is fully described in U.S. Pat. No. 7,350,902, and is incorporated by reference herein in its entirety. Inkjet printer system 10 includes an image data source 12, which provides data signals that are interpreted by a controller 14 as being commands to eject drops. Controller 14 includes an image processing unit 15 for rendering images for printing, and outputs signals to an electrical pulse source 16 of electrical energy pulses that are inputted to an inkjet printhead 100, which includes at least one inkjet printhead die 110.

In the example shown in FIG. 1, there are two nozzle arrays. Nozzles 121 in the first nozzle array 120 have a larger opening area than nozzles 131 in the second nozzle array 130. In this example, each of the two nozzle arrays has two staggered rows of nozzles, each row having a nozzle density of 600 per inch. The effective nozzle density then in each array is 1200 per inch (i.e. d=1/1200 inch in FIG. 1). If pixels on the recording medium 20 were sequentially numbered along the paper advance direction, the nozzles from one row of an array would print the odd numbered pixels, while the nozzles from the other row of the array would print the even numbered pixels.

In fluid communication with each nozzle array is a corresponding ink delivery pathway. Ink delivery pathway 122 is in fluid communication with the first nozzle array 120, and ink delivery pathway 132 is in fluid communication with the second nozzle array 130. Portions of ink delivery pathways 122 and 132 are shown in FIG. 1 as openings through printhead die substrate 111. One or more inkjet printhead die 110 will be included in inkjet printhead 100, but for greater clarity only one inkjet printhead die 110 is shown in FIG. 1. The printhead die are arranged on a support member as discussed below relative to FIG. 2. In FIG. 1, first fluid source 18 supplies ink to first nozzle array 120 via ink delivery pathway 122, and second fluid source 19 supplies ink to second nozzle array 130 via ink delivery pathway 132. Although distinct fluid sources 18 and 19 are shown, in some applications it may be beneficial to have a single fluid source supplying ink to both the first nozzle array 120 and the second nozzle array 130 via ink delivery pathways 122 and 132 respectively. Also, in some embodiments, fewer than two or more than two nozzle arrays can be included on printhead die 110. In some embodiments, all nozzles on inkjet printhead die 110 can be the same size, rather than having multiple sized nozzles on inkjet printhead die 110.

Not shown in FIG. 1, are the drop forming mechanisms associated with the nozzles. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bi-layer element) and thereby cause ejection. In any case, electrical pulses from electrical pulse source 16 are sent to the various drop ejectors according to the desired deposition pattern. In the example of FIG. 1, droplets 181 ejected from the first nozzle array 120 are larger than droplets 182 ejected from the second nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on a recording medium 20.

Figure 2:
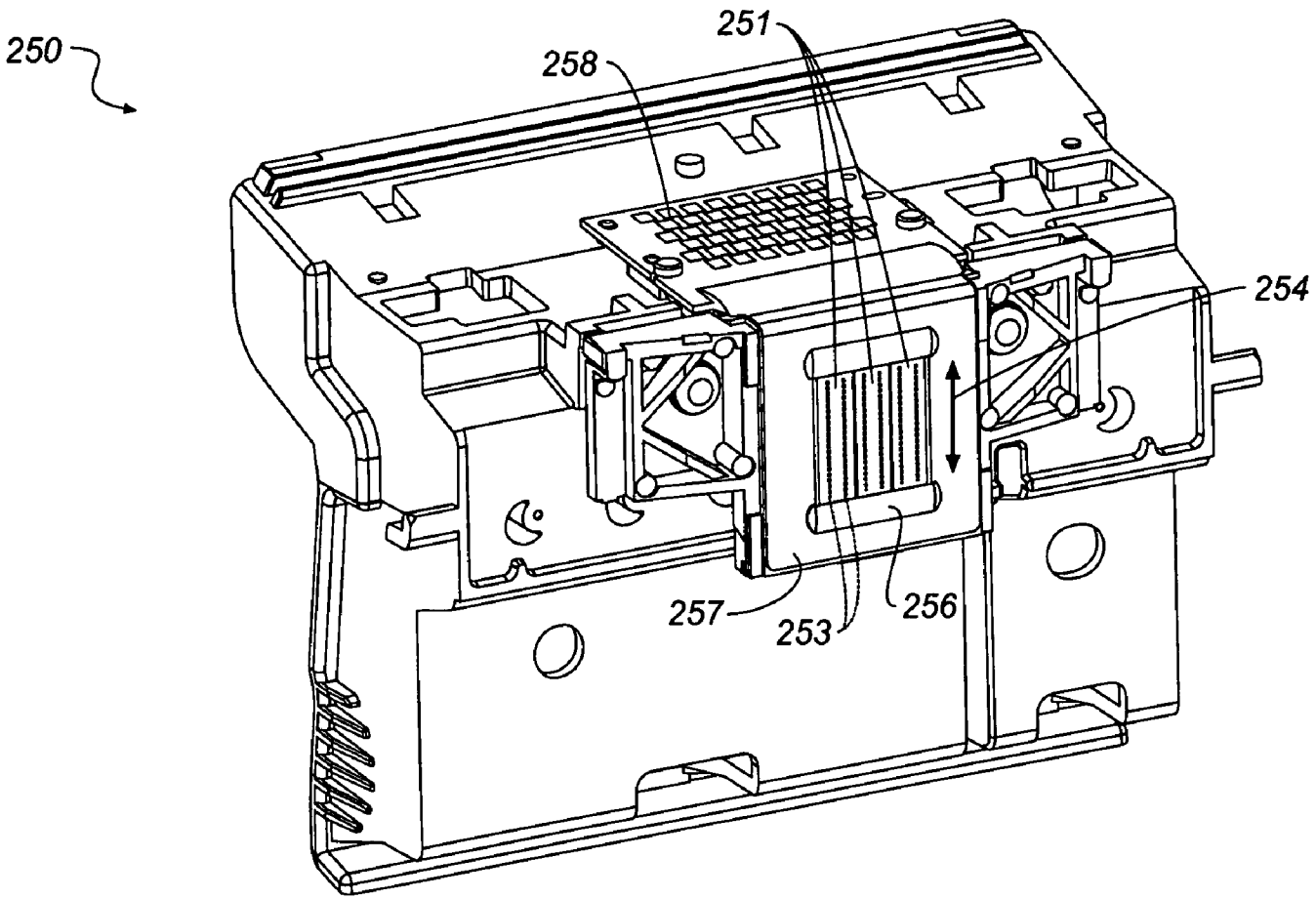
FIG. 2 is a perspective view of a portion of a printhead chassis.

FIG. 2 shows a perspective view of a portion of a printhead chassis 250, which is an example of an inkjet printhead 100. Printhead chassis 250 includes three printhead die 251 (similar to printhead die 110 in FIG. 1), each printhead die 251 containing two nozzle arrays 253, so that printhead chassis 250 contains six nozzle arrays 253 altogether. The six nozzle arrays 253 in this example can each be connected to separate ink sources (not shown in FIG. 2); such as cyan, magenta, yellow, text black, photo black, and a colorless protective printing fluid. Each of the six nozzle arrays 253 is disposed along nozzle array direction 254, and the length of each nozzle array along the nozzle array direction 254 is typically on the order of 1 inch or less. Typical lengths of recording media are 6 inches for photographic prints (4 inches by 6 inches) or 11 inches for paper (8.5 by 11 inches). Thus, in order to print a full image, a number of swaths are successively printed while moving printhead chassis 250 across the recording medium 20. Following the printing of a swath, the recording medium 20 is advanced along a media advance direction that is substantially parallel to nozzle array direction 254.

Also shown in FIG. 2 is a flex circuit 257 to which the printhead die 251 are electrically interconnected, for example, by wire bonding or TAB bonding. The interconnections are covered by an encapsulant 256 to protect them. Flex circuit 257 bends around the side of printhead chassis 250 and connects to connector board 258. When printhead chassis 250 is mounted into the carriage 200 (see FIG. 3), connector board 258 is electrically connected to a connector (not shown) on the carriage 200, so that electrical signals can be transmitted to the printhead die 251.

Figure 3:
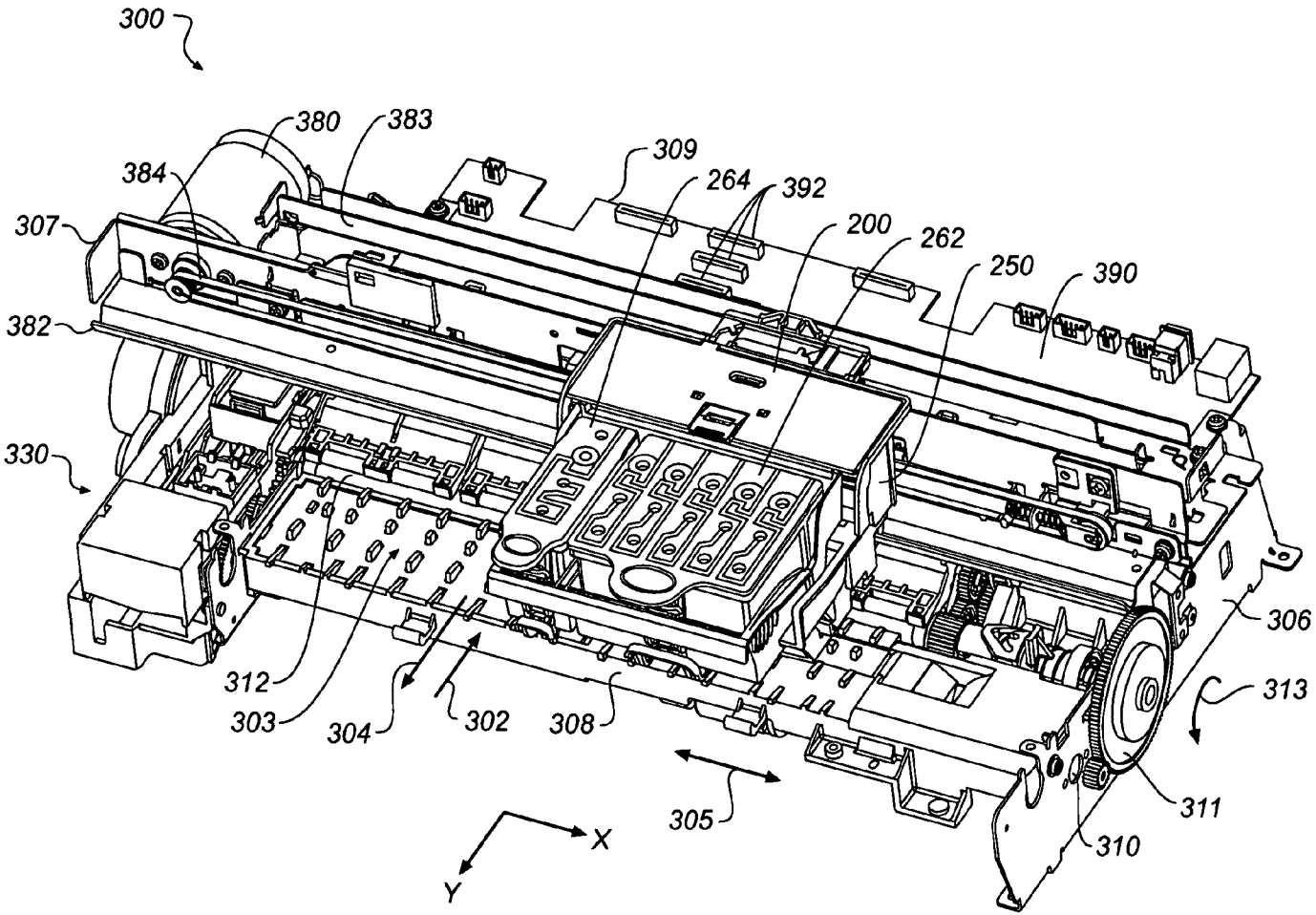
FIG. 3 is a perspective view of a portion of a carriage printer.

FIG. 3 shows a portion of a desktop carriage printer. Some of the parts of the printer have been hidden in the view shown in FIG. 3 so that other parts can be more clearly seen. Printer chassis 300 has a print region 303 across which carriage 200 is moved back and forth in carriage scan direction 305 along the X axis, between the right side 306 and the left side 307 of printer chassis 300, while drops are ejected from printhead die 251 (not shown in FIG. 3) on printhead chassis 250 that is mounted on carriage 200. Carriage motor 380 moves belt 384 to move carriage 200 along carriage guide rail 382. An encoder sensor (not shown) is mounted on carriage 200 and indicates carriage location relative to an encoder fence 383.

Printhead chassis 250 is mounted in carriage 200, and multi-chamber ink supply 262 and single-chamber ink supply 264 are mounted in the printhead chassis 250. The mounting orientation of printhead chassis 250 is rotated relative to the view in FIG. 2, so that the printhead die 251 are located at the bottom side of printhead chassis 250, the droplets of ink being ejected downward onto the recording medium in print region 303 in the view of FIG. 3. Multi-chamber ink supply 262, in this example, contains five ink sources: cyan, magenta, yellow, photo black, and colorless protective fluid; while single-chamber ink supply 264 contains the ink source for text black. Paper or other recording medium (sometimes generically referred to as paper or media herein) is loaded along paper load entry direction 302 toward the front of printer chassis 308.

Figure 4:
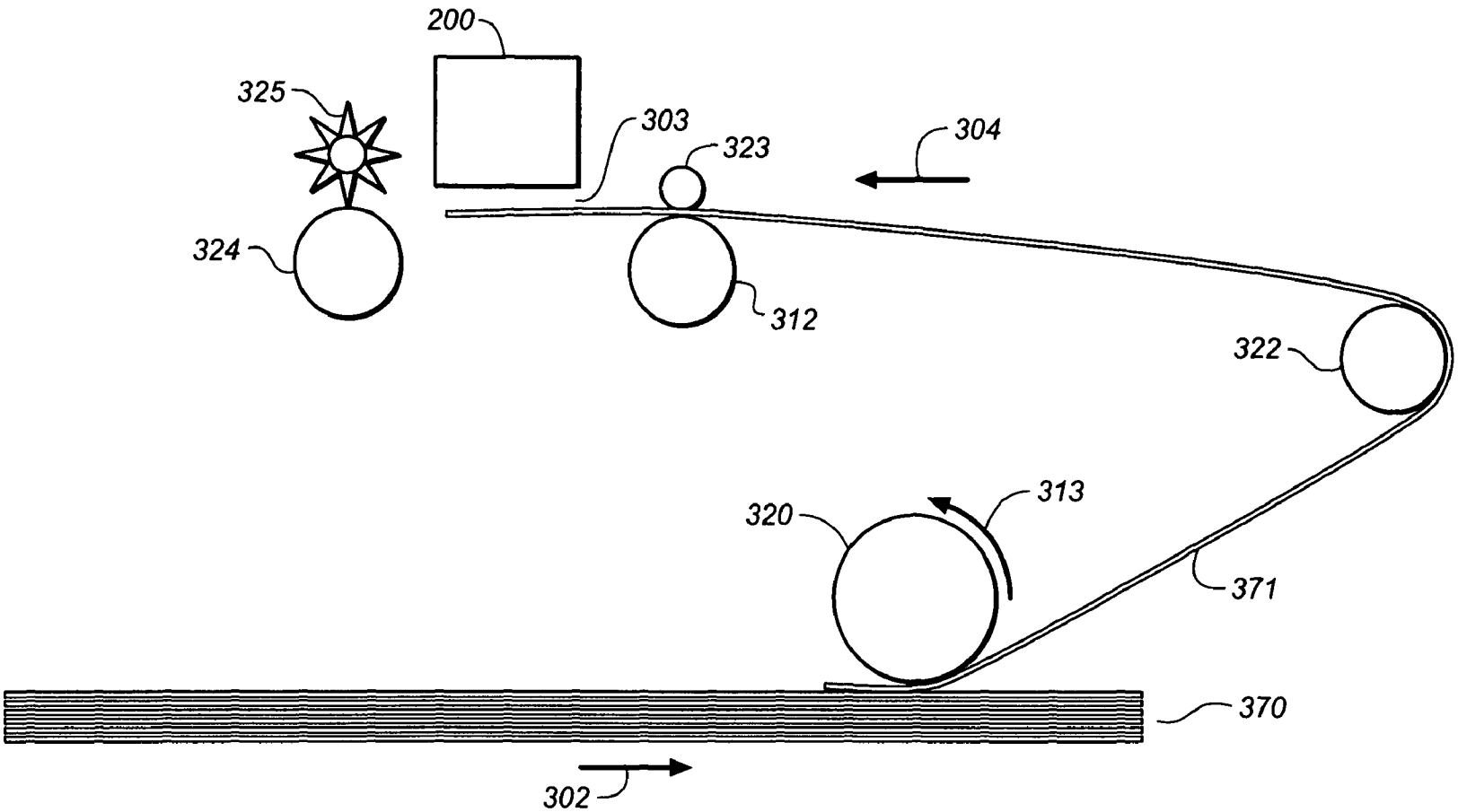
FIG. 4 is a schematic side view of an exemplary paper path in a carriage printer.

A variety of rollers are used to advance the medium through the printer as shown schematically in the side view of FIG. 4. In this example, a pick-up roller 320 moves the top piece or sheet 371 of a stack 370 of paper or other recording medium in the direction of arrow, paper load entry direction 302. A turn roller 322 acts to move the paper around a C-shaped path (in cooperation with a curved rear wall surface) so that the paper continues to advance along media advance direction 304 from the rear 309 of the printer chassis (with reference also to FIG. 3). The paper is then moved by feed roller 312 and idler roller(s) 323 to advance along the Y axis across print region 303, and from there to a discharge roller 324 and star wheel(s) 325 so that printed paper exits along media advance direction 304. Feed roller 312 includes a feed roller shaft along its axis, and feed roller gear 311 (see FIG. 3) is mounted on the feed roller shaft. Feed roller 312 can include a separate roller mounted on the feed roller shaft, or can include a thin high friction coating on the feed roller shaft. A rotary encoder (not shown) can be coaxially mounted on the feed roller shaft in order to monitor the angular rotation of the feed roller.

The motor that powers the paper advance rollers is not shown in FIG. 3, but the hole 310 at the right side of the printer chassis 306 is where the motor gear (not shown) protrudes through in order to engage feed roller gear 311, as well as the gear for the discharge roller (not shown). For normal paper pick-up and feeding, it is desired that all rollers rotate in forward rotation direction 313. Toward the left side of the printer chassis 307, in the example of FIG. 3, is the maintenance station 330.

Toward the rear of the printer chassis 309, in this example, is located the electronics board 390, which includes cable connectors 392 for communicating via cables (not shown) to the printhead carriage 200 and from there to the printhead chassis 250. Also on the electronics board are typically mounted motor controllers for the carriage motor 380 and for the paper advance motor, a processor and/or other control electronics (shown schematically as controller 14 and image processing unit 15 in FIG. 1) for controlling the printing process, and an optional connector for a cable to a host computer.

Figure 5:
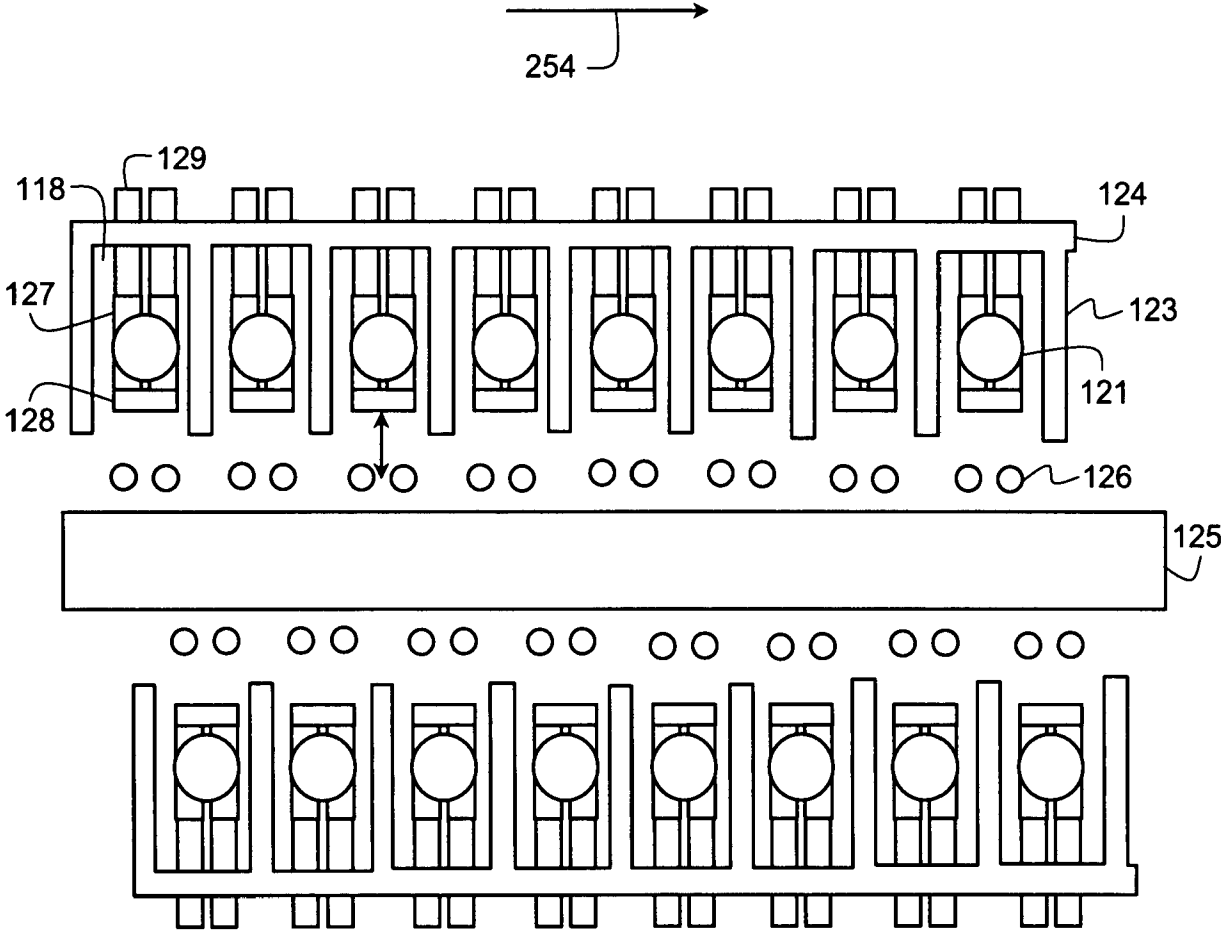
FIG. 5 (PRIOR ART)
FIG. 5 is schematic view of a staggered array of conventional thermal inkjet drop ejectors.

FIG. 5 shows a schematic view of a staggered array of conventional thermal inkjet drop ejectors (disposed along nozzle array direction 254) that can be used in a conventional printhead die 251 (with reference to FIG. 2). Each drop ejector includes a pair of side walls 123 and a back wall 124 that form an enclosure of an ink chamber 118. Within chamber 118 is heater 127 that is associated with nozzle 121. Walls 123 and 124 extend perpendicular to the surface of substrate 111 (see FIG. 1), thereby supporting the nozzle plate containing nozzle 121 at a distance from the surface containing heater 127. In the example of FIG. 5 heater 127 is segmented into two parts that are electrically connected by a shorting bar 128. Opposite the shorting bar are electrical leads 129 that connect the heater to driver electronics (not shown). The ink chambers 118 are supplied with ink by an ink feed passageway 125 through an open end of the enclosure, where the open end is opposite the back wall 123. Ink feed passageway 125 is part of ink delivery passageway 122 of FIG. 1. Between ink feed passageway 125 and the open end of the enclosure is one or more posts 126 or other flow barriers that serve as a source of fluid impedance. The double-headed arrow in FIG. 5 represents the flow of ink during and after drop ejection. In order to fill the chamber 118, the ink flows from ink feed passageway 125, between posts 126 and through the open end of the enclosure. When the drop ejector is fired by providing an electrical pulse to the heater to form a vapor bubble, a drop of ink is ejected through the nozzle by the force of the expanding vapor bubble. Another portion of ink is pushed backward from chamber 118 toward ink feed passageway 125. Posts 126 provide a source of fluid impedance to reduce cross-talk between nearby drop ejectors. After ejection of a drop of ink, the vapor bubble collapses toward the heater surface or vents through the associated nozzle, causing a partial vacuum for a brief time. Ink from the ink feed passageway 125 is drawn into chamber 118 by the partial vacuum, as well as by subsequent weaker but longer-lasting capillary forces due to surface tension.

For a typical inkjet printhead die, adjacent nozzles 121 are spaced apart along nozzle array direction 254 by about 42 microns to provide 600 nozzles per inch on each side of ink feed passageway 125, resulting in an effective printing resolution of 1200 nozzles per inch. Typical inkjet inks have a surface tension of about 30 to 40 dynes/cm and a viscosity of about 1.5 to 4 centipoises. As a result in prior art drop ejectors such as those shown in FIG. 5, the refill time is approximately 50 microseconds for drop ejector geometries designed to provide an ink drop volume of about 6 picoliters. For drop ejector geometries designed to provide an ink drop volume of about 3 picoliters, the refill time is about 35 to 40 microseconds. As a result, the maximum firing frequency of a drop ejector is limited by the chamber refill frequency, which is about 20 kHz for a 6 picoliter drop ejector and about 25 to 30 kHz for a 3 picoliter drop ejector.

In contrast to the disclosure of FIG. 5, embodiments of the present invention relate to operation of a novel drop ejector design in which two drop ejectors are paired together within the same ink chamber. The two drop ejectors are separated by a dividing wall, such that ink is able to flow around both ends of the dividing wall. The two drop ejectors are fired one after the other with a delay time between firings. The delay time is chosen such that firing the second drop ejector helps the first drop ejector to refill faster.

Figure 6:
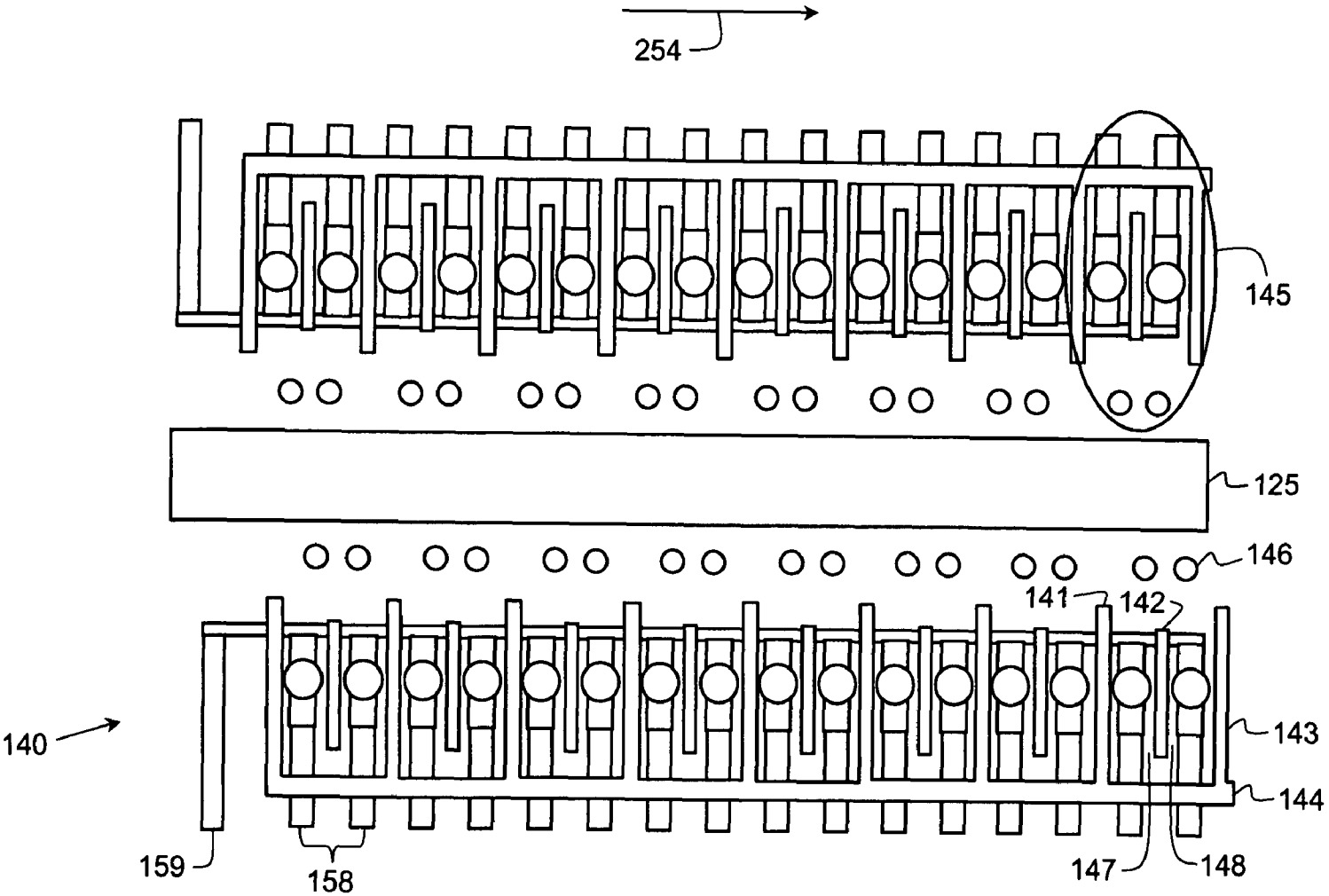
FIG. 6 is schematic view of a staggered array of paired thermal inkjet drop ejectors, according to an embodiment of the invention.
Figure 7B:
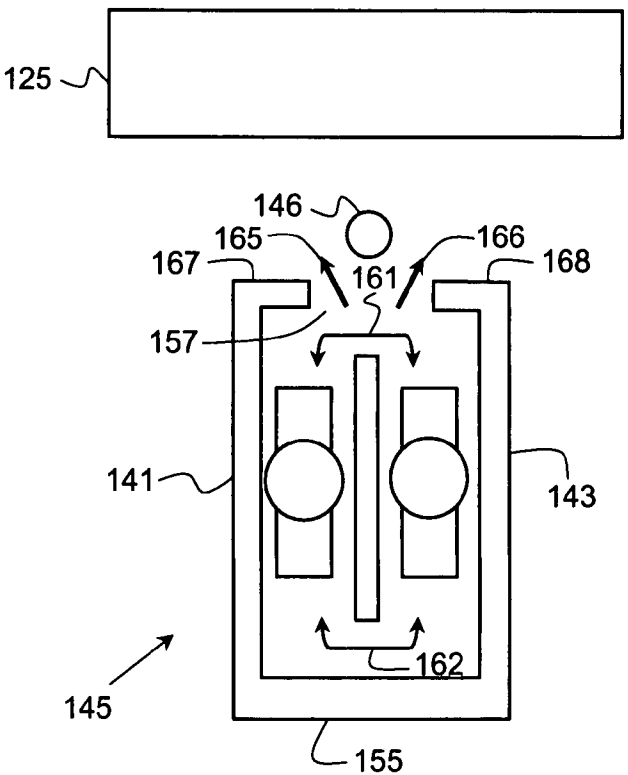
FIGS. 7A and 7B are schematic views of paired drop ejectors, according to first and second embodiments of the invention respectively.
Figure 7A:
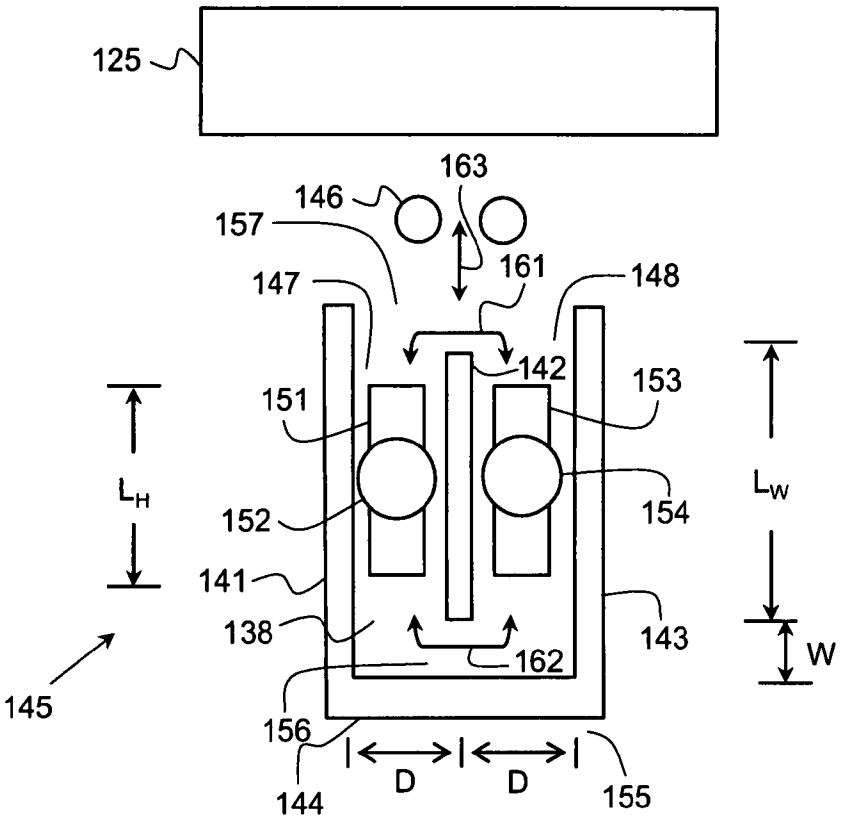

FIG. 6 shows an array 140 of paired drop ejectors 145 (disposed along nozzle array direction 254) and FIG. 7A shows one paired drop ejector 145 according to a first embodiment of the invention. Such an array 140 of paired drop ejectors 140 can be included on a printhead die 251 that is part of a printhead 250 that can be installed in a printer such as printer 300, with reference to FIGS. 2 and 3. In the paired drop ejector 145 of FIGS. 6 and 7A, side walls 141 and 143 and back wall 144 define ink chamber 138. Dividing wall 142 divides the ink chamber 138 into a first portion 147 and a second portion 148. Dividing wall 142 has a length that is less than the length of side walls 141 and 143. First heater 151 and first nozzle 152 of the paired drop ejector 145 are disposed in first portion 147, while second heater 153 and second nozzle 154 of the paired drop ejector are disposed in second portion 148. In the embodiment of FIGS. 6 and 7A, ink chamber 138 has a closed end 155 formed by back wall 144 and an open end 157. A gap 156 is provided between closed end 155 and the nearest end of dividing wall 142. Electrical leads are shown in FIG. 6, but not in FIG. 7A for clarity. Heater leads 158 are provided between each heater and a respective drive transistor (not shown). A common lead 159 optionally provides power to a plurality of heaters.

Flow patterns for the paired drop ejector 145 are shown in FIG. 7A. Ink or other liquid is supplied from ink feed passageway 125 between posts 146 through open end 157 of ink chamber 138 to first portion 147 and second portion 148, as indicated by one end of arrow 163. When one of the two heaters 151 or 153 is fired and a drop is ejected, a portion of ink is pushed backward toward posts 146 as indicated by the other end of arrow 163. However, some ink is pushed from the fired portion of the chamber to the nonfired portion of the ink chamber 138. The flow from one portion of the chamber to the other occurs both through gap 156 between the dividing wall 142 and the closed end 155 as indicated by arrow 162, and also around the other end of the dividing wall 142 near open end 157 as indicated by arrow 161.

By properly timing the firing of the first heater 151 and the second heater 153 relative to one another, the cross-flow of ink from one portion to the other can help the respective portions refill more quickly. For example, if a first electrical pulse of about 2 microseconds is provided to first heater 151, providing thermal energy to cause an ink vapor bubble to form on first heater 151 and expand in order to eject a drop of ink from first nozzle 152, the vapor bubble will collapse toward the heater surface or vent through the associated nozzle within a few microseconds after the beginning of the first pulse. During bubble expansion, ink is pushed from first portion 147 toward posts 146 and toward second portion 148. During bubble collapse or venting, a partial vacuum is created that pulls ink toward first portion 147 from second portion 148, (including through gap 156 between dividing wall 142 and closed end 155) as well as from ink feed passageway 125 through open end 157 of ink chamber 138. Following bubble collapse or venting, capillary forces continue to pull ink toward first portion 147. If a second electrical pulse is provided to second heater 153 after a suitable first predetermined delay time of 2 to 20 microseconds relative to the first electrical pulse, for example, so that a vapor bubble is formed on second heater 153, a drop of ink is ejected from second nozzle 154. In addition, ink from second portion 148 is pushed toward posts 146 and toward first portion 147 (including through gap 156), at the same time that ink is refilling first portion 147 following ejection of the drop from first nozzle 152, thus facilitating refill of first portion 147. It is typically advantageous for the first predetermined delay time to be greater than a time interval from the beginning of the first electrical pulse to the time of collapse or venting of the vapor bubble in the first portion 147 of the enclosure. If the first predetermined delay time is too short, the volume of the drop ejected from the second nozzle 154 will be too small due to reduced pressure or duration of the vapor bubble in the second portion 148 of the enclosure.

Similarly, after a suitable second delay time of about 5 to 50 microseconds, for example, relative to the second electrical pulse, a third electrical pulse is provided to the first heater 151 of the paired drop ejector. (The third electrical pulse is the second pulse provided in the sequence of pulses provided to the first heater 151.) A vapor bubble forms and grows on the first heater 151, ejecting a second drop of ink out of first nozzle 152, but also pushing ink toward posts 146 and toward second portion 148 (including through gap 156). If the second delay time is such that the pushing of ink toward second portion 148 occurs during refill of second portion 148, then the ejection of this second drop of ink out of first nozzle 152 will assist the refill of second portion 148. It is typically advantageous for the second predetermined delay time to be greater than a time interval from the beginning of the second electrical pulse to the time of collapse or venting of the vapor bubble in the second portion 148 of the enclosure. If the second predetermined delay time is too short, the volume of the drop ejected from the first nozzle 152 will be too small due to reduced pressure or duration of the vapor bubble in the first portion 147 of the enclosure.

In some cases the second delay time will be the same as or substantially the same as the first delay time. In other cases the second delay time will be longer than the first delay time. For example, in a printing application of a paired drop ejector, some pixels in an image will require two drops of ink. When the image data indicates to the controller that such a pixel is to be printed, the first heater 151 will be fired, followed by the second heater 153 after the first predetermined delay time. At a time interval after the second pulse equal to the first predetermined delay time, the nozzles 152 and 154 might be suitably positioned relative to the print medium to eject ink for the next drops to be printed from the paired drop ejector. In such a case, the second delay time can be equal to the first predetermined delay time. However, the nozzles might not yet be suitably positioned relative to the next desired ink spot location, or the image data may indicate that no ink is to be printed at that location. In such a case, the second delay time can be longer than the first predetermined delay time. If the second delay time is significantly longer than the first predetermined delay time, the firing of the second heater 154 might not help the first portion 147 refill appreciably. However, also if the second delay time is significantly longer than the first predetermined delay time, the first portion 147 is still provided sufficient time to refill independently without assistance from the firing of second heater 153.

In many instances, after a time interval equal to the first predetermined delay time has elapsed relative to the third electrical pulse, a fourth electrical pulse is provided to the second heater 153. (The fourth electrical pulse is the second pulse provided in the sequence of pulses provided to the second heater 152.) A vapor bubble forms on the second heater 153 and ejects a drop of ink from nozzle 154. In addition, ink from second portion 148 is pushed toward first portion 147 to help refill first portion 147. However, it is not always required that a fourth electrical pulse be provided to the second heater 153 at the first predetermined delay time after the third electrical pulse is provided to the first heater 151.

Because the portions of the paired drop ejector assist each other in refill, a quantity of ink can be deposited more quickly from paired drop ejectors 145 than from the conventional drop ejector of FIG. 5. As mentioned above, a single conventional drop ejector can eject a 6 picoliter drop at a refill frequency of about 20 kHz. A paired drop ejector can eject two 3 picoliter drops (6 picoliters total) with a refill frequency for the pair of about 40 kHz (i.e. about twice as fast for the same amount of ink). Paired drop ejectors can be designed to eject drops of a variety of sizes. In one example, a paired drop ejector can be designed to eject a 1 picoliter droplet from the first nozzle. In another example, a paired drop ejector can be designed to eject a 10 picoliter droplet from the first nozzle. Although paired drop ejectors can also be designed to eject droplets larger than 10 picoliters or smaller than 1 picoliter, many printing applications will benefit from paired drop ejector designs that eject drops within the range of 1 to 10 picoliters.

In many embodiments of paired drop ejectors, it will be advantageous for the pair to be symmetrically designed, so that substantially equally sized drops are ejected from both members of the pair. For such cases, it is advantageous to have dividing wall 142 parallel to the side walls 141 and 143 and equally spaced from them, e.g. at a distance D from each of the side walls, so that the first portion 147 is the same size as the second portion 148. In such embodiments, it can also be advantageous for the size and the shape of first heater 151 to be equal to the size and shape of second heater 153. Likewise in such embodiments, it can be advantageous for the size and the shape of first nozzle 153 to be equal to the size and shape of second nozzle 154. (However, it is also contemplated herein, that for some embodiments it can be preferred to have unequally sized drops ejected from the members of the pair, so that the sizes and shapes of heaters and nozzles and the placement of the dividing wall need not be symmetric in such embodiments.)

For proper operation of a paired drop ejector, ink flows must be considered in the design. It is typically advantageous for the length $L_W$ of the dividing wall 142 to be longer than both the lengths $L_H$ of the first heater 151 and the second heater 153. That way, the expanding vapor bubble is forced to expand both toward the open end 157 and toward the closed end 155 so that ink is pushed in those directions. Open end 157 of the enclosure is closer to ink feed passageway 125 than closed end 155 is. In other words, the open end 157 of the enclosure is disposed proximate to the ink feed passageway 125 and the closed end 155 of the enclosure is disposed distal to the ink feed passageway 125. Typically it is advantageous to have one or more flow barriers, such as posts 146 located near the open end 157, e.g. between open end 157 and ink feed passageway 125. Such flow barriers provide a backflow impedance that can help to eject larger drops and to reduce cross-talk between paired drop ejectors. FIG. 7B shows a second embodiment of a paired drop ejector 145 having partial walls extending from each side wall as another type of flow barrier near open end 157. In particular, first partial wall 167 extends from side wall 141 at open end 157 toward second side wall 143, and second partial wall 168 extends from second side wall 143 at open end 157 toward first side wall 141. The paired drop ejector of FIG. 7B also has a post 146 serving as a flow barrier near open end 157. Arrows 165 and 166 indicate an ink flow pattern for ink pushed back toward ink feed passageway 125 after firing drops of ink from the paired drop ejector. Curved arrows 161 and 162 show ink flow to assist refilling of the first and second portion, as in FIG. 7A.

The size of the ink flow passage at the gap 156 between dividing wall 142 and closed end 155 will partly depend on the size of the paired drop ejector. Scaled relative to the distance D between the dividing wall and the side walls 141 and 143, the width W of the ink flow passage at gap 156 will typically be between 0.2D and 5D. For a typical sized paired drop ejector, the width W of the ink flow passage at gap 156 will be between 5 microns and 100 microns. In some embodiments, the distance between the end of dividing wall 142 closest to the closed end 155 is substantially equal to the distance between the other end of the dividing wall 142 and open end 157 of the enclosure.

Figure 8B:
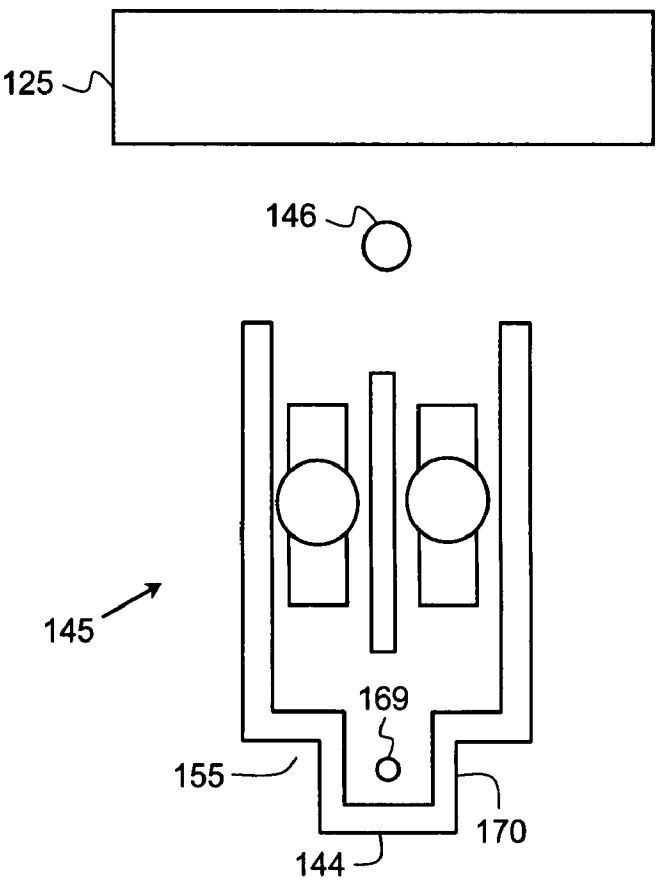
FIGS. 8A and 8B are schematic views of paired drop ejectors, according to embodiments of the invention.
Figure 8A:
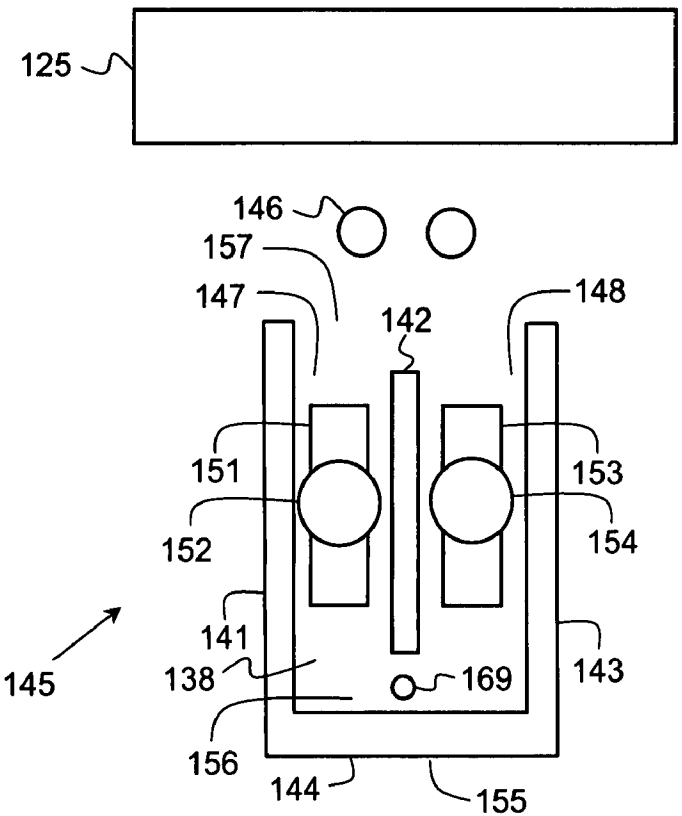

In some embodiments, it is advantageous to provide a small vent hole 169 in the nozzle plate near the back wall 144 of ink chamber 138, as shown in FIGS. 8A and 8B. Since the nozzle plate forms the roof of the closed end 155 of the ink chamber, it can be said that the vent is disposed in the closed end 155. The function of the vent hole 169 is to vent air from chamber 138 during priming to enable complete filling of ink chamber 138. Priming generally occurs by applying suction to the nozzle face of the printhead. Without the vent hole 169, air bubbles can remain in the dead space between nozzles 152 and 154 and the closed end 155 of ink chamber 138. Such air bubbles would provide an undesirable source of compliance, such that the drop ejectors would not fire properly or not at all. It is preferable not to have the vent hole 169 too close to nozzles 152 and 154, but rather be spaced apart from them. If the vent hole 169 is too close to nozzles 152 and 154, or if the vent hole is too large, ink can be undesirably ejected from the vent hole 169 during ejection of drops of ink from nozzles 152 and 154. In practice, a cross-sectional dimension (such as a diameter of a circularly shaped vent hole 169) should be between 1 micron and about 5 microns. In order to space vent hole 169 far enough from nozzles 152 and 154, in some embodiments a projection portion 170 is provided in the closed end 155, and the vent hole 169 is disposed within the projection portion 170, as shown in FIG. 8B.

Figure 9:
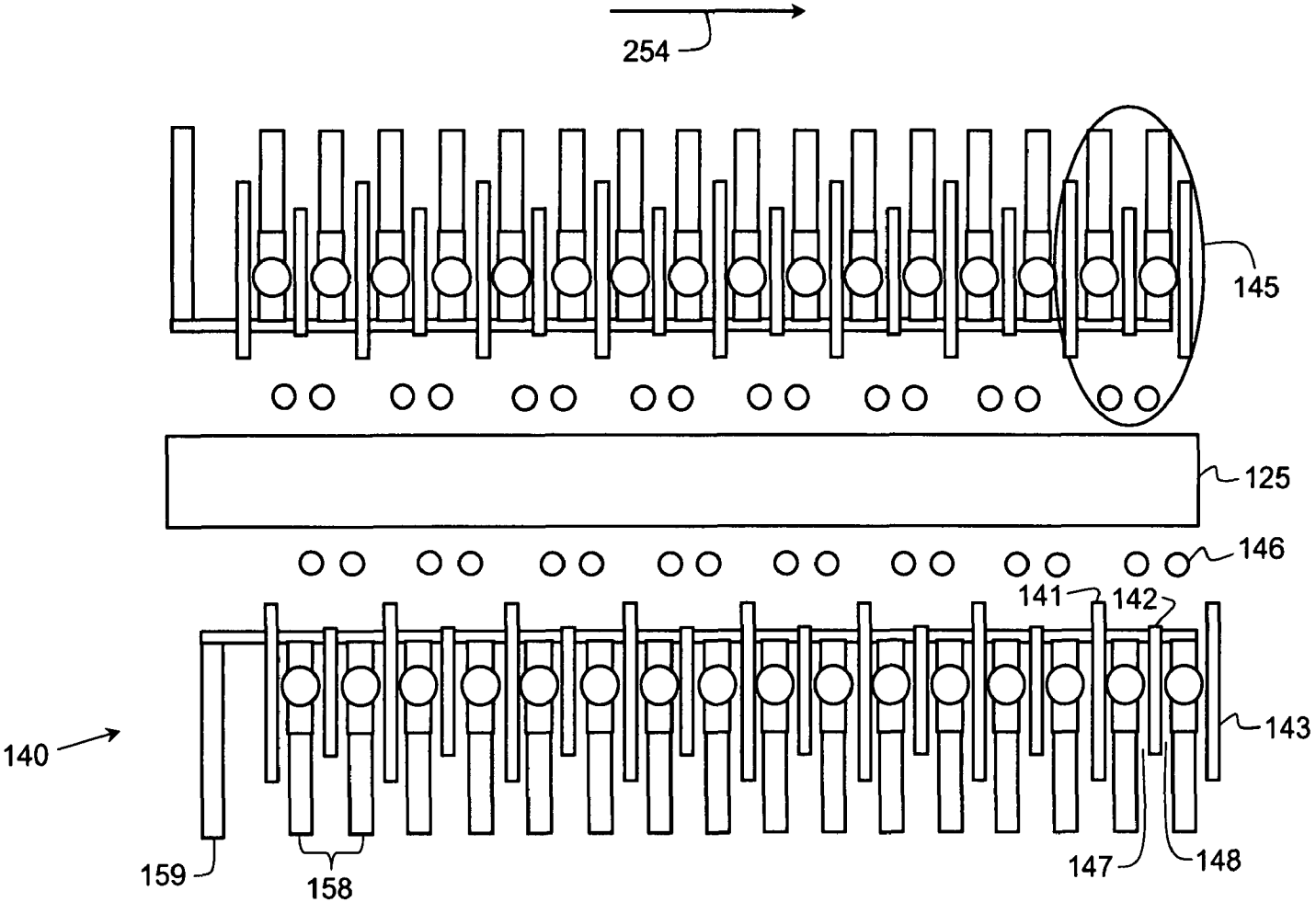
FIG. 9 is schematic view of a staggered array of paired thermal inkjet drop ejectors, according to an embodiment of the invention.

In embodiments of the present invention described above, ink chamber 138 of paired drop ejector 145 includes a closed end 155 formed by back wall 144. FIG. 9 shows an embodiment in which ink chamber 138 of paired drop ejector 145 does not have a closed end 155 or a back wall 144. In the embodiment of FIG. 9, the pairing association of paired drop ejector 145 is provided by dividing wall 142 having a length that is less than the length of side walls 141 and 143 in order to permit flow from first portion 147 and second portion 148 around each end of ink chamber 138. Operation of the paired drop ejector 145 of FIG. 9 is similar to that described above relative to FIGS. 6 and 7, although details of performance and timing of firings can be different.

The successive firing of first heater 151 and second heater 153 will result in two drops of ink landing on the print medium. Depending on timing and ink properties, the two drops can merge into one drop, or they can be displaced from one another, resulting in two spots that are displaced from one another. Spot displacement can be both along the array direction (since the nozzles 152 and 154 are displaced from one another) and along the direction of relative motion of the printhead and print medium, due to the delay time between the firing of heaters 151 and 153. In a carriage printer such as printer 300 of FIG. 3, the printhead is moved along carriage scan direction 305 during ejection of drops from the first nozzle 152 and the second nozzle 154. In a pagewidth printer, the print medium is typically moved during ejection of drops from the first nozzle and the second nozzle of the paired drop ejector.

Figure 10B:
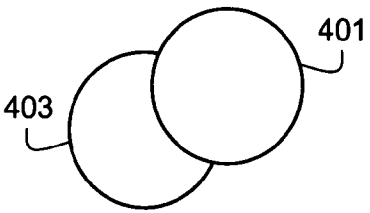
FIGS. 10A to 10D are patterns of dots made by drops ejected from a paired drop ejector in a first location, according to embodiments of the invention.
Figure 10D:
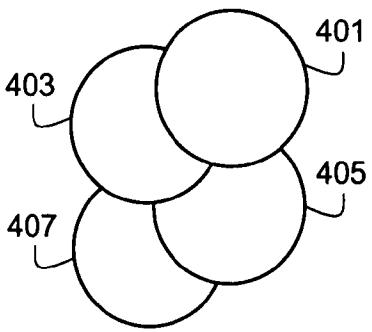
Figure 10A:
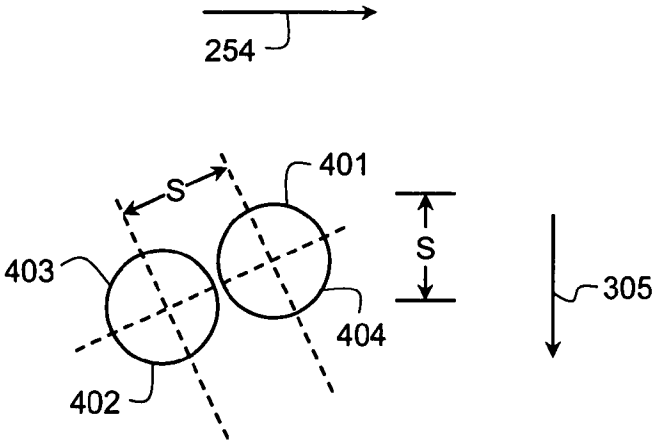

FIG. 10A schematically shows spots 401 and 403 ejected from nozzles 152 and 154 respectively onto a print medium. In the example of FIG. 10A, the two spots 401 and 403 are completely nonoverlapping and displaced from each other both in a direction parallel to nozzle array direction 254 and also in a direction (such as carriage scan direction 305) that is parallel to the relative motion of the printhead and the print medium. In this example, spot 401 is substantially the same size (e.g. having a same diameter S) as spot 403. Spot 401 has a centroid 402 that is displaced a distance s from centroid 404 of spot 403. In some embodiments, s is greater than 5 microns and less than 20 microns. When s is smaller than a spot size dimension (such as a diameter S of a circular spot), the two spots 401 and 403 will partially overlap each other, as shown in FIG. 10B.

Figure 10C:
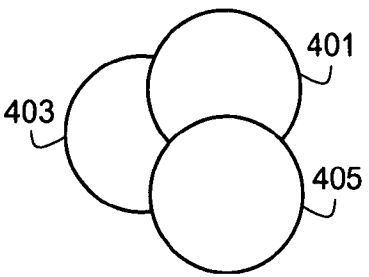

FIG. 10C is similar to FIG. 10B, but also shows a second spot 405 that has been ejected from nozzle 152 at a later time than spot 401. As described above, a first electrical pulse provided to heater 151 causes a droplet of ink to be ejected from nozzle 152, which results in spot 401. After the first predetermined delay time relative to the first electrical pulse, a second electrical pulse is provided to heater 153, which causes a droplet of ink to be ejected from nozzle 154, resulting in spot 403. After the second delay time relative to the second electrical pulse, a third electrical pulse is provided to heater 151, which causes a droplet of ink to be ejected from nozzle 152, resulting in spot 405.

FIG. 10D is similar to FIG. 10C, but also shows a second spot 407 that has been ejected from nozzle 154 at a later time than spot 403. In particular, after the elapse of the first predetermined delay time relative to the third electrical pulse, a fourth electrical pulse is provided to heater 153, which causes a droplet of ink to be ejected from nozzle 154, resulting in spot 407.

In some print modes of a printer having a printhead with an array of paired drop ejectors, all pixels to be printed in the image are printed by a pair of spots such as shown in FIG. 10A (or FIG. 10B for the case of overlapping spots). In other words, each pixel includes a drop of ink from the first nozzle of the pair and a drop of ink from the second nozzle of the pair.

Figure 11A:
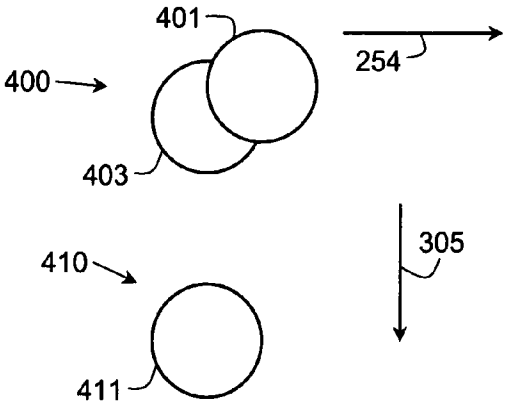
FIGS. 11A to 11D are patterns of dots made by drops ejected from a paired drop ejector in a first location and a second location, according to embodiments of the invention.
Figure 11B:
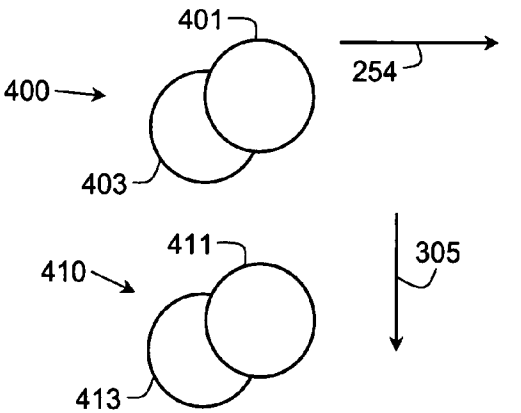
Figure 11C:
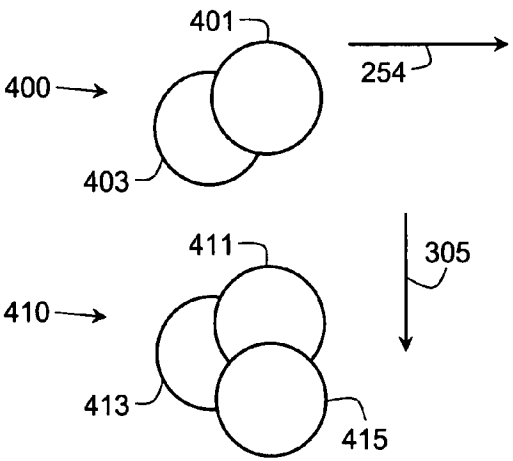
Figure 11D:
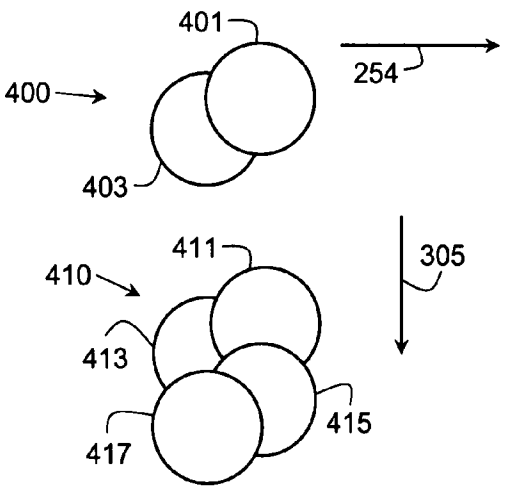

In other print modes of a printer having a printhead with an array of paired drop ejectors, some pixels to be printed in the image can be printed by one spot (e.g. only spot 401), while other groups of pixels can be printed by two spots as in FIG. 10B, or by three spots as in FIG. 10C, or by four spots as in FIG. 10D. Such a print mode can have a greater range of gray scale, resulting in a higher quality printed image. FIGS. 11A to 11D show a pixel at first location 400 including two spots 401 and 403 printed respectively by the first and second heaters with the spot from the second heater delayed by the predetermined first delay time. FIG. 11A shows a pixel at second location 410 including a single spot 411 printed by the first heater after a second delay time that is longer than the predetermined first delay time. FIG. 11B shows a pixel at second location 410 including a pair of spots 411 and 413. Spot 413 was printed by the second heater at the predetermined first delay time after spot 411 was printed by the first heater, but both spots 411 and 413 were printed at a delay time longer than the predetermined first delay time relative to spots 401 and 403. FIG. 11C shows a pixel at a second location 410 including three spots 411, 413 and 415. In this example, spot 411 was printed by the first heater, followed by spot 413 by the second heater after the predetermined first delay time, followed by spot 415 by the first heater after the predetermined first delay time. Similarly FIG. 11D shows a pixel at second location 410 including four spots 411, 413, 415 and 417, alternatingly printed by the first and second heaters and successively delayed by the predetermined first delay time.

In referring to spot configurations herein, spots that are adjacent can be near to one another but not overlapping if centroid spacing s is greater than spot size S, as in FIG. 10A. Spots that are adjacent can be overlapping if centroid spacing s is less than or equal to spot size S, as in FIG. 10B. If the centroid spacing s is greater than or equal to twice the spot size S, the spots are said to be at different locations, such as first location 400 and second location 410 in FIGS. 11A to 11D.

In the various print modes of the printer, controller 14 (with reference to FIG. 1) manages the timing of ejecting drops of ink to print the various pixels according to the relative position of the printhead and the print medium upon which the image is to be printed. Ink from an ink source is provided to the first portion and second portion of the paired drop ejector. To eject a pair of drops from the paired drop ejector to represent a given pixel that is to be printed according to data from image data source 12, a signal is sent from controller 15 to electrical pulse source 16 to send a first electrical pulse to the first heater of the paired drop ejector for ejecting a droplet of ink from the first nozzle toward the print medium. After a predetermined delay time, controller 15 sends a signal to electrical pulse source 16 to send a second electrical pulse to the second heater of the paired drop ejector for ejecting a droplet of ink from the second nozzle toward the print medium.

To eject a trio of spots from the paired drop ejector (similar to FIG. 10C) to represent a given pixel that is to be printed according to data from image data source 12, a signal is sent from controller 15 to electrical pulse source 16 to send a first electrical pulse to the first heater of the paired drop ejector for ejecting a droplet of ink from the first nozzle toward the print medium. After a predetermined delay time, controller 15 sends a signal to electrical pulse source 16 to send a second electrical pulse to the second heater of the paired drop ejector for ejecting a droplet of ink from the second nozzle toward the print medium. After a second delay time relative to the second electrical pulse (where the second delay time is typically equal to the first predetermined delay time), controller 15 sends a signal to electrical pulse source 16 to send a third electrical pulse to the first heater of the paired drop ejector for ejecting a droplet of ink from the first nozzle toward the print medium.

To eject four spots from the paired drop ejector (similar to FIG. 10D) to represent a given pixel that is to be printed according to data from image data source 12, a signal is sent from controller 15 to electrical pulse source 16 to send a first electrical pulse to the first heater of the paired drop ejector for ejecting a droplet of ink from the first nozzle toward the print medium. After a predetermined delay time, controller 15 sends a signal to electrical pulse source 16 to send a second electrical pulse to the second heater of the paired drop ejector for ejecting a droplet of ink from the second nozzle toward the print medium. After a second delay time relative to the second electrical pulse (where the second delay time is typically equal to the predetermined delay time), controller 15 sends a signal to electrical pulse source 16 to send a third electrical pulse to the first heater of the paired drop ejector for ejecting a droplet of ink from the first nozzle toward the print medium. After the predetermined delay time relative to the third electrical pulse, controller 15 sends a signal to electrical pulse source 16 to send a fourth electrical pulse to the second heater of the paired drop ejector for ejecting a droplet of ink from the second nozzle toward the print medium.

The invention has been described in detail with particular reference to certain preferred embodiments thereof, but it will be understood that variations and modifications can be effected within the spirit and scope of the invention.

PARTS LIST

10 Inkjet printer system
12 Image data source
14 Controller
15 Image processing unit
16 Electrical pulse source
18 First fluid source
19 Second fluid source
20 Recording medium
100 Inkjet printhead
110 Inkjet printhead die
111 Substrate
118 Chamber
120 First nozzle array
121 Nozzle(s)
122 Ink delivery pathway (for first nozzle array)
123 Side wall
124 Back wall
125 Ink feed passageway
126 Post
127 Heater
128 Shorting bar
129 Leads
130 Second nozzle array
131 Nozzle(s)
132 Ink delivery pathway (for second nozzle array)
138 Ink chamber

140 Array of paired ejectors
141 Side wall
142 Dividing wall
143 Side wall
144 Back wall
145 Paired drop ejector
146 Post
147 First portion
148 Second portion
151 First heater
152 First nozzle
153 Second heater
154 Second nozzle
155 Closed end
156 Gap
157 Open end
158 Heater leads
159 Common lead
161 Curved arrow
162 Curved arrow
163 Arrow
165 Arrow
166 Arrow
167 First partial wall
168 Second partial wall
169 Vent hole
170 Projection
181 Droplet(s) (ejected from first nozzle array)
182 Droplet(s) (ejected from second nozzle array)
200 Carriage
250 Printhead chassis
251 Printhead die
253 Nozzle array
254 Nozzle array direction
256 Encapsulant
257 Flex circuit
258 Connector board
262 Multi-chamber ink supply
264 Single-chamber ink supply
300 Printer chassis
302 Paper load entry direction
303 Print region
304 Media advance direction
305 Carriage scan direction
306 Right side of printer chassis
307 Left side of printer chassis
308 Front of printer chassis
309 Rear of printer chassis
310 Hole (for paper advance motor drive gear)
311 Feed roller gear
312 Feed roller
313 Forward rotation direction (of feed roller)
320 Pick-up roller
322 Turn roller
323 Idler roller
324 Discharge roller
325 Star wheel(s)
330 Maintenance station
370 Stack of media
371 Top piece of medium
380 Carriage motor
382 Carriage guide rail
383 Encoder fence
384 Belt
390 Printer electronics board
392 Cable connectors
400 First location
401 First spot
402 Centroid of first spot
403 Second spot
404 Centroid of second spot
405 Third spot
407 Fourth spot
410 Second location
411 First spot
413 Second spot
415 Third spot
417 Fourth spot

The invention claimed is:

1. A method of ejecting droplets of liquid from a paired drop ejector, the method comprising the steps of:

providing a chamber having a dividing wall that forms a first and second portion and the first portion includes a first nozzle mated with a first heater and the second portion includes a second nozzle mated with a second heater;

providing liquid to the first portion and second portions of the chamber through an open end of the chamber;

providing a first electrical pulse to the first heater to provide thermal energy for ejecting a droplet of liquid from the first nozzle;

providing a second electrical pulse to the second heater to provide thermal energy for ejecting a droplet of liquid from the second nozzle; wherein the second electrical pulse is delayed relative to the first electrical pulse by a predetermined delay time; and selecting the predetermined delay time such that the ejecting of a droplet of liquid from the second nozzle facilitates refilling of liquid into the first portion of the enclosure.

2. The method of claim 1, wherein refilling of liquid into the first portion of the chamber comprises:

refilling of liquid into the first portion from the open end of the chamber; and refilling of liquid into the first portion from the second portion through a gap between the dividing wall and a closed end of the chamber.

3. The method of claim 1, wherein the delay predetermined time is greater than 2 microseconds and less than 20 microseconds.

4. The method as in claim 1, wherein the first electrical pulse causes a vapor bubble to form, and wherein a time from a beginning of the first electrical pulse to a collapse of the vapor bubble is less than the predetermined delay time.

5. The method as in claim 1, wherein the first electrical pulse causes a vapor bubble to form, and wherein a time from a beginning of the first electrical pulse to a venting of the vapor bubble is less than the first predetermined delay time.

6. The method of claim 1, wherein the liquid is ink.

7. The method of claim 1, wherein a size of the droplet ejected from the first nozzle is substantially equal to the size of the droplet ejected from the second nozzle.

8. The method of claim 7, wherein the size of the droplet ejected from the first nozzle is between 1 picoliter and 10 picoliters.

9. A method of ejecting droplets of liquid from a paired drop ejector, the method comprising the steps of:

providing a chamber having a dividing wall that forms a first and second portion and the first portion includes a first nozzle mated with a first heater and the second portion includes a second nozzle mated with a second heater;

providing liquid to the first portion and second portions of the chamber through an open end of the chamber;

providing a first electrical pulse to the first heater to provide thermal energy for ejecting a droplet of liquid from the first nozzle;

providing a second electrical pulse to the second heater to provide thermal energy for ejecting a droplet of liquid from the second nozzle; wherein the second electrical pulse is delayed relative to the first electrical pulse by a first predetermined delay time; and providing a third electrical pulse to the first heater to provide thermal energy for ejecting a droplet of liquid from the first nozzle; wherein the third electrical pulse is delayed a second predetermined delay time relative to the first electrical pulse.

10. The method as in claim 9, wherein the first and second delay times are the same or substantially the same time.

11. The method of claim 10, wherein the second predetermined delay time is greater than 10 microseconds and less than 50 microseconds.

12. The method as in claim 9, wherein the second delay time is longer than the first delay time.

13. The method as in claim 9 further comprising providing a fourth electrical pulse to the second heater to provide thermal energy for ejecting a droplet of liquid from the second nozzle, the fourth electrical pulse being delayed relative to the third electrical pulse by the first predetermined delay time.

14. A method of printing from a printhead, the method comprising the steps of:

providing a paired drop ejector having a first heater and a first nozzle disposed within a first portion of a chamber and a second heater and a second nozzle disposed within a second portion of the chamber, the first portion and the second portion of the chamber being separated by a dividing wall;

providing ink from an ink source to the first portion and second portion of the chamber through an open end of the chamber;

sending a signal from a controller to send a first electrical pulse to the first heater to provide thermal energy for ejecting a droplet of ink from the first nozzle toward a print medium;

sending a signal from the controller to send a second electrical pulse to the second heater to provide thermal energy for ejecting a droplet of ink from the second nozzle toward the print medium, the second electrical pulse being delayed relative to the first electrical pulse by a predetermined delay time, wherein the ink from the first and second nozzles form a pair of adjacent spots in a location; and wherein a centroid of the spot of ink ejected from the first nozzle is displaced from a centroid of the spot of ink ejected from the second nozzle by a distance that is greater than 5 microns and less than 20 microns.

15. The method of claim 14, wherein a size of the spot of ink ejected from the first nozzle is substantially the same as a size of the spot of ink ejected from the second nozzle.

16. The method of claim 14, wherein the spot of ink ejected from the first nozzle partially overlaps the spot of ink ejected from the second nozzle.

17. The method of claim 14, wherein the printhead is moved during ejection of drops from the first nozzle and the second nozzle.

18. The method of claim 14, wherein the print medium is moved during ejection of drops from the first nozzle and the second nozzle.

19. A method of printing from a printhead, the method comprising the steps of:

providing a paired drop ejector having a first heater and a first nozzle disposed within a first portion of a chamber and a second heater and a second nozzle disposed within a second portion of the chamber, the first portion and the second portion of the chamber being separated by a dividing wall;

providing ink from an ink source to the first portion and second portion of the enclosure through an open end of the enclosure;

sending a signal from a controller to send a first electrical pulse to the first heater to provide thermal energy for ejecting a droplet of ink from the first nozzle toward a print medium;

sending a signal from the controller to send a second electrical pulse to the second heater to provide thermal energy for ejecting a droplet of ink from the second nozzle toward the print medium, the second electrical pulse being delayed relative to the first electrical pulse by a predetermined delay time, wherein the ink from the first and second nozzles form a pair of adjacent spots in a first location; and sending a signal from the controller to send a third electrical pulse to the first heater to provide thermal energy for ejecting a droplet of ink from the first nozzle toward the print medium, wherein the third pulse is delayed in time relative to the first and second pulses to provide a spot of ink in a second location or the first location.

20. The method as in claim 19 further comprising sending a signal from the controller to send a fourth electrical pulse to the second heater to provide thermal energy for ejecting a droplet of ink from the second nozzle toward the print medium, wherein the fourth pulse is delayed in time relative to the third pulse to provide a spot of ink in a second location or the first location.

* * * * *